US006431854B1

(12) United States Patent
Fang

(10) Patent No.: US 6,431,854 B1
(45) Date of Patent: Aug. 13, 2002

(54) GAS LIGHTER WITH SAFETY DEVICE

(76) Inventor: Ming Fang, 17070 E. Colima Rd., #281, Hacienda Heights, CA (US) 91745

( * ) Notice: Subject to any disclaimer, the term of this patent is extended or adjusted under 35 U.S.C. 154(b) by 0 days.

(21) Appl. No.: 10/029,499

(22) Filed: Dec. 18, 2001

(51) Int. Cl.[7] ..... F23Q 2/46
(52) U.S. Cl. ..... 431/153; 431/277
(58) Field of Search ..... 431/153, 277, 431/276, 275, 344, 274

(56) References Cited

U.S. PATENT DOCUMENTS

| | | | | | |
|---|---|---|---|---|---|
| 5,490,773 | A | | 2/1996 | Capilla | |
| 5,547,370 | A | * | 8/1996 | Hwang | 431/276 |
| 5,769,625 | A | | 6/1998 | Sher | |
| 5,913,674 | A | * | 6/1999 | Shimizu | 431/277 |
| 5,971,749 | A | * | 10/1999 | Chen | 431/277 |
| 6,053,727 | A | | 4/2000 | Potskhishvili | |
| 6,074,198 | A | * | 6/2000 | Rogelet | 431/153 |
| 6,099,296 | A | * | 8/2000 | Wang | 431/153 |
| 6,220,853 | B1 | * | 4/2001 | Luo | 431/153 |
| 6,273,709 | B1 | | 8/2001 | Potskhishvili | |

* cited by examiner

*Primary Examiner*—James C. Yeung
(74) *Attorney, Agent, or Firm*—Thomas I. Rozsa; Tony D. Chen

(57) ABSTRACT

A safety fuel lighter with an improved ignitor assembly, including a striker wheel which rotates about an axis in response to force applied to the striker wheel by a user's thumb or finger. The striker wheel has an annular center portion, two outer annular portions sandwiching the center portion, and a bore extending through the center portion and the two outer portions. An axle is positioned within the bore of the striker wheel, where the axle has a diameter which is smaller than the diameter of the bore. A mounting frame has a spring receptacle and a pair of mounting holes for receiving the axle so that the striker wheel can move from a first position to a second position. A spring is received within the spring receptacle and positioned below a flint. The spring exerts a compressive force against the flint and forces the flint into contact with the striker wheel. The compressive force exerted by the spring being insufficient to cause the flint to generate sparks when the striker wheel is in the first position and rotated, and the compressive force exerted by the spring being sufficient to cause the flint to generate sparks when the striker wheel is in the second position and rotated.

9 Claims, 3 Drawing Sheets

GAS LIGHTER WITH SAFETY DEVICE

BACKGROUND OF THE INVENTION

1. Field of the Invention

The present invention relates generally to the field of disposable lighters. More particularly, the present invention relates to the field of fuel lighters having an improved child safety strike wheel assembly for preventing children from igniting the lighter.

2. Description of the Prior Art

Specifically, conventional disposable and non-disposable fuel lighters are well known in the art. It is known that small children love to play with fuel lighters, thereby resulting in burns or even fires. Therefore, there is a need to incorporate a safety feature with conventional fuel lighters to make them more difficult to ignite by children.

The following four (4) prior art patents are found to be pertinent to the field of the present invention:

1. U.S. Pat. No. 5,490,773 issued to Lloveras Capilla on Feb. 13, 1996 for "Pocket Lighter" (hereafter the "Lloveras Capilla Patent");
2. U.S. Pat. No. 5,769,625 issued to Sher on Jun. 23, 1998 for "Safety Lighter With Smooth Striker Wheel Edges" (hereafter the "Sher Patent");
3. U.S. Pat. No. 6,053,727 issued to Potskhishvili et al. on Apr. 25, 2000 for "Gas Lighter With Safety Device" (hereafter "the '727 Potskhishvili Patent"); and
4. U.S. Pat. No. 6,273,709 issued to Potskhishvili et al. on Aug. 14, 2001 for "Gas Lighter With Safety Device" (hereafter "the '709 Potskhishvili Patent").

The Lloveras Capilla Patent discloses a pocket lighter. It includes a spark wheel which produces sparks and movable between a first position in which it is blocked from rotating in the first direction. The wheel urges towards the first position when being actuated to rotate in the first direction and a second position in which it is adapted to rotate in the first direction and produces sparks directed towards the valve.

The Sher Patent discloses a safety lighter with smooth striker wheel edges. It includes a striker wheel which rotates about an axis in response to force applied to the wheel by a user's finger. The annular recessed center portion of the striker wheel's outer annular surface has protuberances formed thereon, while the annular unrecessed lateral portions of the striker wheel's outer annular surface are smooth. The striker wheel is mounted to the lighter in slots which allow translation of the striker wheel toward and away from the lighters's flint. The striker wheel is pressed from a first portion having insufficient spring force to cause the lighter flint to spark when the striker wheel is rotated into a second position having sufficient spring force to cause the lighter flint to spark when the striker wheel is rotated.

The '727 Potskhishvili Patent discloses a gas lighter with a safety device. It includes a gas ignition which has a gearwheel secured to a spigot and corrugated wheels positioned on a shaft. The shaft has a central portion on which the gearwheel is positioned and which is formed as a polyhedron. The shaft is mounted within bracket openings so that it moves along a direction of the flint spring action. An opening of the gearwheel is polyhedral, whereby a maximum diameter of the shaft in the area of the gearwheel installation is less than a minimum diameter of the opening of the gearwheel spigot, whereby in the absence of a force on the corrugated wheels, a gap is formed between the gearwheel spigot and the support the size of which gap is less than the stroke of the shaft end portions within the bracket openings.

The '709 Potskhishvili Patent discloses a gas lighter with a safety device. It includes a gas ignition device having a gear wheel freely and rotatably positioned on a shaft which is rotatably located in openings of body brackets and a flint spring pressed toward the gearwheel. When a finger pad acts on support wheels, a spark is prevented from being struck since the gearwheel will not rotate. In order to ignite the gas, it is necessary to slightly depress the support wheels so that a portion of the surface of the finger pad contacts the gearwheel, such that the gearwheel rotations and spark striking occur.

It is desirable to design and construct an improved safety lighter which includes an improved ignitor assembly which not only makes the safety lighter difficult to ignite and thereby reduces the injuries resulting from children playing with the lighters, but also easy to use and simple in construction and thereby minimizes the cost of manufacturing the safety lighters with the improved ignitor assembly.

SUMMARY OF THE INVENTION

The present invention is a safety fuel lighter with an improved ignitor assembly. The ignitor assembly comprises a striker wheel which rotates about an axis in response to force applied to the striker wheel by a user's thumb or finger.

The ignitor assembly includes a striker wheel having an annular center portion, two opposite disposed outer annular portions sandwiching the center portion, and a transverse bore extending through the center portion and the two outer portions. An axle is positioned within the bore of the striker wheel, where the axle has a diameter which is smaller than the diameter of the bore. A mounting frame is attached on top of a fuel reservoir body and has a nozzle which is actuated by an actuating lever which is pivotally mounted on the mounting frame for releasing the fuel contained within the fuel reservoir body. The mounting frame has a spring receptacle and a pair of mounting holes for receiving the axle so that the striker wheel can move from a first position to a second position. A spring is received within the spring receptacle and positioned below a flint. The spring exerts a compressive force against the flint and forces the flint into contact with the striker wheel. The compressive force exerted by the spring being insufficient to cause the flint to generate sparks when the striker wheel is in the first position and rotated, and the compressive force exerted by the spring being sufficient to cause the flint to generate sparks when the striker wheel is in the second position and rotated.

It is an object of the present invention to provide a safety lighter with an improved ignitor assembly that is easily operated by an adult, but very difficult to use by a child.

It is an additional object of the present invention to provide a safety lighter with a strike wheel having a diameter which is larger than the diameter of an axle positioned therein so that the striker wheel can move from a first position to a second position, whereby when a spring exerts a compressive force against a flint and forces the flint into contact with the striker wheel, the compressive force exerted by the spring being insufficient to cause the flint to generate sparks when the striker wheel is in the first position and rotated, and the compressive force exerted by the spring being sufficient to cause the flint to generate sparks when the striker wheel is in the second position and rotated.

It is a further object of the present invention to provide a safety lighter which is simple in construction, easy to use and low manufacturing cost.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
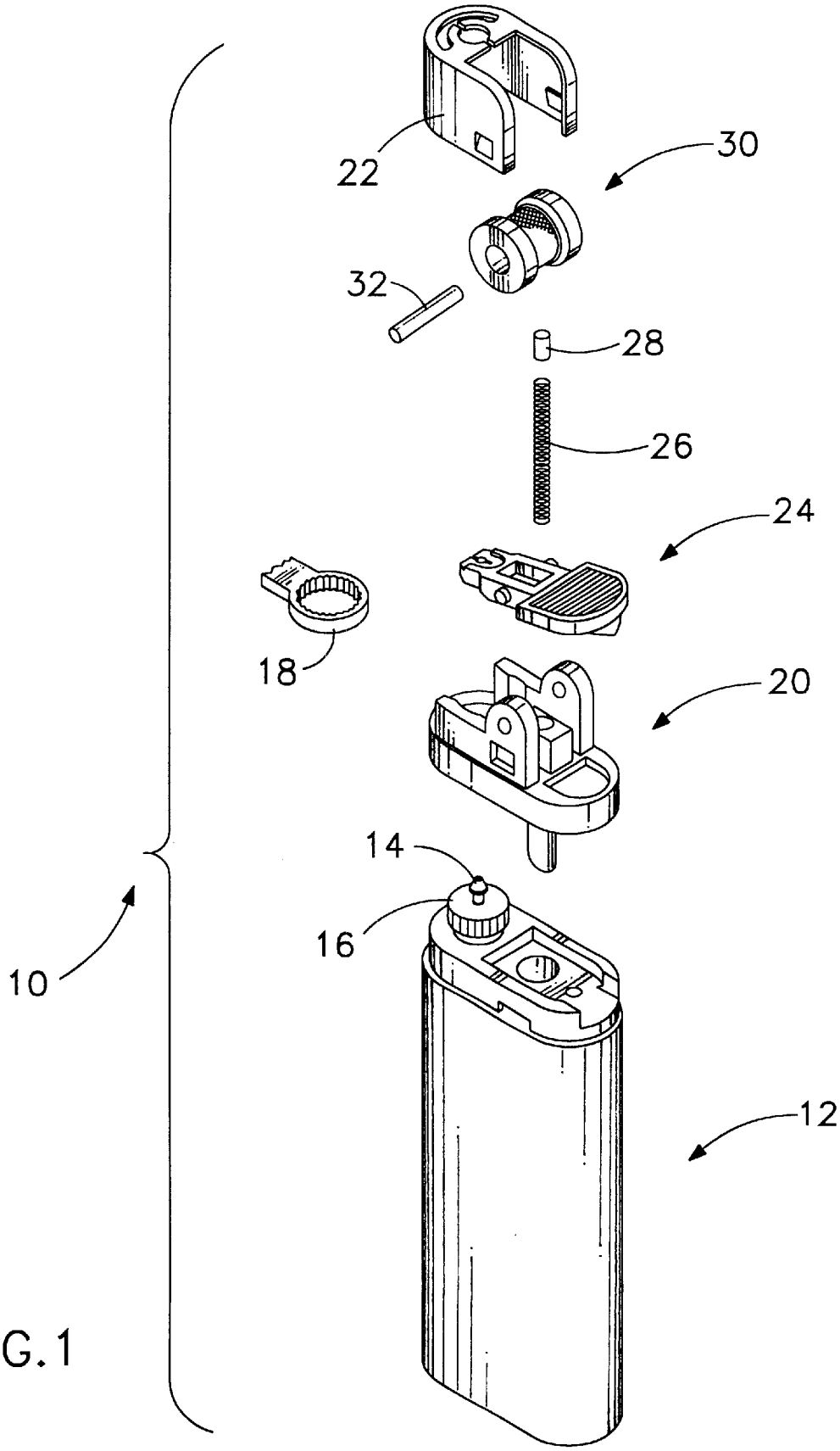
FIG. 1 is an exploded perspective view of the present invention safety lighter with an improved ignitor assembly.

Referring to FIG. 1, there is shown an exploded view of the present invention safety gas lighter 10 with components commonly mounted on a fuel reservoir body 12 in which lighter fuel is contained therein. The gas lighter 10 includes a valve or flame nozzle 14 having a head and a downwardly extending tube disposed toward the front of the fuel reservoir body 12, a flame adjustment wheel 16, a thumb adjustment actuator 18 which is connected to the flame adjustment wheel 16, a mounting frame 20, a windshield 22, a nozzle actuating lever 24, and an igniter assembly comprising a flint spring 26, a flint 28, a striker wheel 30, and an axle 32.

In normal operation, the striker wheel 30 is rotated and the rear of the nozzle actuating lever 24 is depressed virtually simultaneously, which causes the nozzle 14 to be raised and a spark to be created when the knurling surface of the striker wheel 30 fictionally engage the flint 28. The spark ignites the fuel and a flame is maintained so long as the rear of the lever 24 is continued to be depressed downward.

Figure 2:
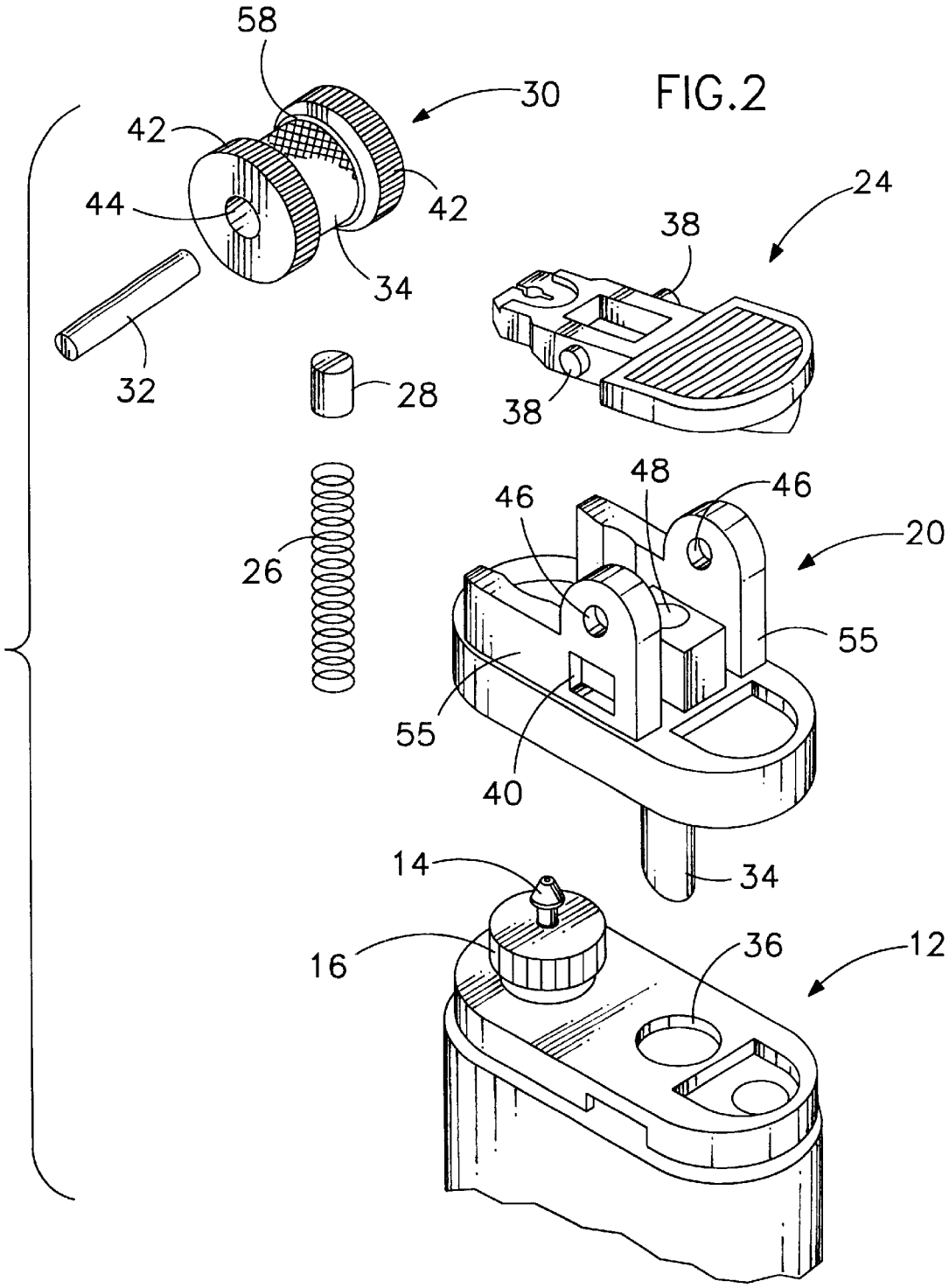
FIG. 2 is an enlarged exploded detailed view of an upper portion of the safety lighter shown in FIG. 1, showing the improvement of the present invention safety lighter.
Figure 3:
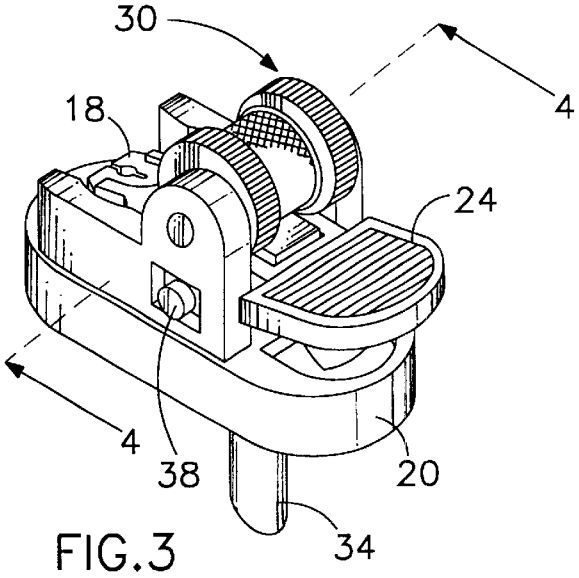
FIG. 3 is a perspective view of the ignitor assembly in accordance with the present invention safety lighter.

Referring to FIGS. 1, 2 and 3, the mounting frame 20 is mounted on top of the reservoir body 12 with a hollow frame stem 34 inserted into a longitudinal bore 36 in the fuel reservoir body 12. The mounting frame 20 has two upright support walls 55 located opposite and parallel to each other. The nozzle actuating lever 24 is mounted on the frame 20 with two pivots 38 respectively inserted into two slots 40 (only one is shown) of the support walls 55. The striker wheel 30 is formed in the shape of a wheel having an annular center portion 34 which is sandwiched between two annular outer lateral thumb grip portions 42. The annular center portion 34 is secured to the outer portions 42 by annular flanges 58 which are formed with outer portions 42. The annular center portion 34 has an external knurling surface which will strike against the flint 28 with instantaneously high friction. This knurling surface provides a gripping surface against which the user's thumb will rest and frictionally engage such that movement of the thumb will cause the striker wheel 30 to rotate. When the user's thumb causes the striker wheel 30 to rotate, the knurling surface extending out from the annular center portion 34 of the striker wheel 30 creates sparks upon striking the flint 28, and a flame is caused to be ignited from the head of the nozzle 14 from which fuel is being ejected while the nozzle actuating lever 24 is being held down.

Figure 5:
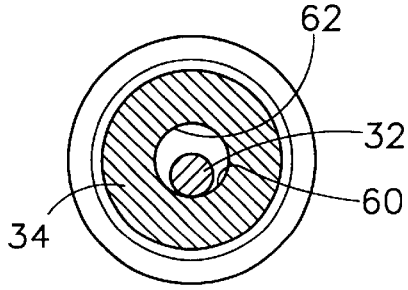
FIG. 5 is a cross-sectional view taken along line 5—5 of FIG. 4.
Figure 6:
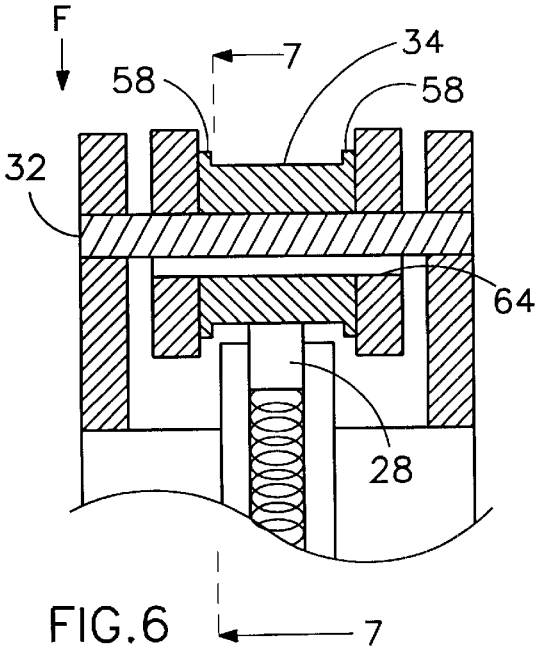
FIG. 6 is a partial cross-sectional view of the upper portion of the safety lighter, showing a force being applied to the striker wheel.
Figure 7:
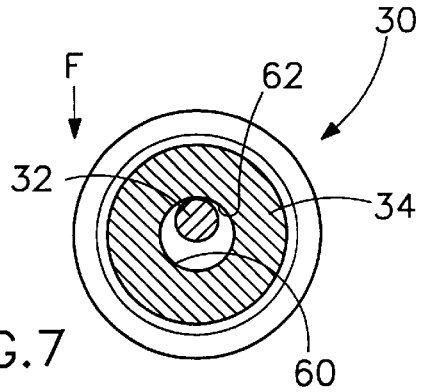
FIG. 7 is a cross-sectional view taken along line 7—7 of FIG. 6.

The striker wheel 30 has an enlarged axis bore 44 which extends between the two annular lateral thumb grip portions 42 for allowing the axle 32 to be inserted thereto. The diameter of the axle 32 is smaller than the axis bore 44 as shown in FIGS. 5 through 7. The striker wheel 30 is then mounted onto the mounting frame 20 with the axle 32 fitted into supporting holes 46. The flint 28 and the spring 26 are mounted into a hole 48 of the mounting frame 20 in the conventional fashion so as to urge the flint 28 toward the knurling surface of the annular center portion 34 of the striker wheel 30.

Figure 4:
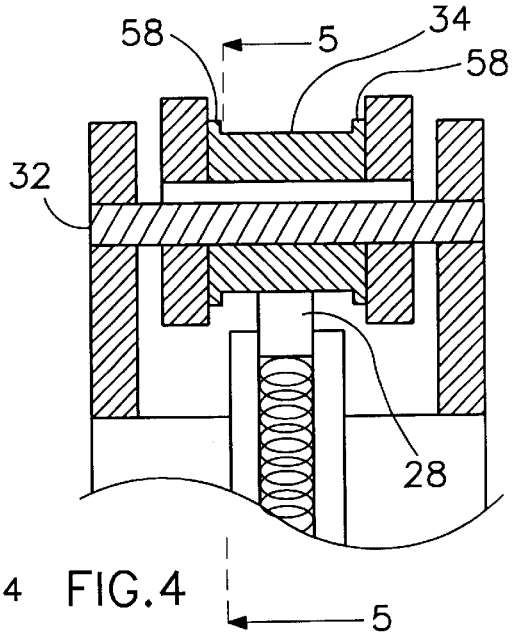
FIG. 4 is a partial cross-sectional view of the upper portion of the safety lighter, showing no force being applied to the striker wheel.

In the preferred embodiment of the present invention safety gas lighter 10, the axle 32 is fixed to the mounting frame 20, while the striker wheel 30 can rotate around the axle 32. By virtue of this configuration, as the annular lateral portions 42 of the striker wheel 30 is depressed, striker wheel 30 is moved from a first position 60 which is located at a lower surface of the axis bore 44 (see FIGS. 4 and 5) to a second position 62 which at an upper surface of the axis bore 44 (see FIGS. 6 and 7). As the striker wheel 30 is thus moved, the flint spring 26 is compressed and exerts an increased force against the flint 28, which in turn exerts an increased force against the knurling surface of the annular center portion 34. When the striker wheel 30 is in the first position 60, the force exerted by the flint spring 26 against the flint 28, and in turn the force exerted by the flint 28 against the knurling surface of the annular center portion 34 is insufficient to create sparks when the striker wheel 30 is rotated by the user. However, when the striker wheel 30 is in the second position 62, the increased force exerted by the flint spring 26 against the flint 28, and in turn the increased force exerted by the flint 28 against the knurling surface of the annular center portion 34 is sufficient to create sparks when the striker wheel 30 is rotated by the user.

Referring to FIGS. 4, 5, 6, and 7, to generate sparks which light the lighter's flame, a user must first exert a force "F" (shown in FIGS. 6 and 7) against the striker wheel 30, this force "F" being sufficient to overcome the compressive force exerted by the fling spring 26. This sufficient force "F" will move the striker wheel 30 from the first position 60 to the second position 62, compressing the spring 26 and thereby causing the spring 26 to exert a greater force against the flint 28.

Only in response to this greater force can the flint 28 exert a force against the protuberance surface of the center portion 34 sufficient to generate sparks when the striker wheel 30 is rotated by the user. The force "F" exerted by the user must also be enough to establish sufficient gripping friction between the user's finger and the annular lateral portions 42 of the striker wheel 30, in order to rotate the striker wheel 30. The amount of force required to make the striker wheel 30 rotate is within the range of forces capable of being administered by an adult, but beyond the range of forces capable of being administered by a child.

Defined in detail, the present invention is a safety gas lighter, comprising: (a) a fuel reservoir body having a top end; (b) a strike wheel having an annular center portion, two opposite disposed outer annular portions sandwiching the center portion, and a transverse bore extending through the center portion and the two outer portions, the annular center portion having a knurling surface; (c) an axle positioned within the transverse bore of the striker wheel and having a diameter which is smaller than the diameter of the transverse bore; (d) a mounting frame attached on top of the fuel reservoir body and having a nozzle which is actuated by an actuating lever which is pivotally mounted on the mounting frame for releasing the fuel contained within the fuel reservoir body, the mounting frame further having a spring receptacle and two upright supporting walls located parallel to each other and on opposite sides of the spring receptacle, each supporting wall having a mounting hole for fixedly receiving the axle thereto so that the striker wheel can be moved from an upper position to a lower position; (e) a spring received within the spring receptacle; (f) a flint positioned above the spring; and (g) the spring exerting a compressive force against the flint and forcing the flint into contact with the knurling surface of the annular center portion of the striker wheel, the compressive force exerted by the spring being insufficient to cause the flint to generate sparks when the striker wheel is in the upper position and rotated, and the compressive force exerted by the spring being sufficient to cause the flint to generate sparks when the striker wheel is in the lower position and rotated.

Defined broadly, the present invention is a safety lighter, comprising: (a) a fuel reservoir body having a top end; (b) a striker wheel having an annular center portion, two opposite disposed outer portions sandwiching the center portion, and a bore extending through the center portion and the two outer portions, the center portion having a rough surface formed thereon; (c) an axle positioned within the bore of the striker wheel and having a diameter which is smaller than the diameter of the bore; (d) a mounting frame attached to the top end of the fuel reservoir body and having a spring receptacle and a pair of mounting slots located on opposite sides for fixedly receiving the axle so that the striker wheel can be moved from a first position to a second position; (e) a spring received within the spring receptacle; (f) a flint positioned above the spring; and (g) the spring exerting a compressive force against the flint and forcing the flint into contact with the rough surface of the center portion of the striker wheel, the compressive force exerted by the spring being insufficient to cause the flint to generate sparks when the striker wheel is in the first position and the compressive force exerted by the spring being sufficient to cause the flint to generate sparks when the striker wheel is in the second position.

Defined more broadly, the present invention is an igniter assembly used in conjunction with a fuel lighter having a fuel reservoir body, the igniter assembly comprising: (a) a strike wheel having an internal axis bore extending therethrough and an external striking surface being in contact with a flint for generating sparks directed toward a nozzle when the striking surface is driven to strike against the flint; (b) an axle positioned within the internal axis bore of the striker wheel and having a diameter which is smaller than the diameter of the bore; (c) a mounting frame attached the fuel reservoir body and having a spring receptacle and a pair of mounting holes for receiving the axle so that the striker wheel can move from a first position to a second position; (d) spring means received within the spring receptacle and positioned below the flint; and (e) the spring means exerting a compressive force against the flint and forcing the flint into contact with the striking surface of the striker wheel, the compressive force exerted by the spring means being insufficient to cause the flint to generate sparks when the striker wheel is in the first position and rotated, and the compressive force exerted by the spring being sufficient to cause the flint to generate sparks when the striker wheel is in the second position and rotated.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A safety gas lighter, comprising:

a. a fuel reservoir body having a top end;

b. a strike wheel having an annular center portion, two opposite disposed outer annular portions sandwiching the center portion, and a transverse bore extending through the center portion and the two outer portions, the annular center portion having a knurling surface;

c. an axle positioned within said transverse bore of said striker wheel and having a diameter which is smaller than the diameter of said transverse bore;

d. a mounting frame attached on top of said fuel reservoir body and having a nozzle which is actuated by an actuating lever which is pivotally mounted on the mounting frame for releasing the fuel contained within said fuel reservoir body, the mounting frame further having a spring receptacle and two upright supporting walls located parallel to each other and on opposite sides of the spring receptacle, each supporting wall having a mounting hole for fixedly receiving said axle thereto so that said striker wheel can be moved from an upper position to a lower position;

e. a spring received within said spring receptacle;

f. a flint positioned above said spring; and g. said spring exerting a compressive force against said flint and forcing said flint into contact with said knurling surface of said annular center portion of said striker wheel, the compressive force exerted by said spring being insufficient to cause said flint to generate sparks when said striker wheel is in said upper position and rotated, and the compressive force exerted by said spring being sufficient to cause said flint to generate sparks when said striker wheel is in said lower position and rotated.

2. A safety lighter, comprising:

a. a fuel reservoir body having a top end;

b. a striker wheel having an annular center portion, two opposite disposed outer portions sandwiching the center portion, and a bore extending through the center portion and the two outer portions, the center portion having a rough surface formed thereon;

c. an axle positioned within said bore of said striker wheel and having a diameter which is smaller than the diameter of said bore;

d. a mounting frame attached to said top end of said fuel reservoir body and having a spring receptacle and a pair of mounting slots located on opposite sides for fixedly receiving said axle so that said striker wheel can be moved from a first position to a second position;

e. a spring received within said spring receptacle;

f. a flint positioned above said spring; and g. said spring exerting a compressive force against said flint and forcing said flint into contact with said rough surface of said center portion of said striker wheel, the compressive force exerted by said spring being insufficient to cause said flint to generate sparks when said striker wheel is in said first position and the compressive force exerted by said spring being sufficient to cause said flint to generate sparks when said striker wheel is in said second position.

3. The safety lighter in accordance with claim 2, wherein said rough surface of said annular center portion comprises a knurling surface.

4. The safety lighter in accordance with claim 2, wherein said first position is located on a lower surface of said bore of said striker wheel.

5. The safety lighter in accordance with claim 2, wherein said second position is located on an upper surface of said bore of said striker wheel and remote from said first position.

6. An igniter assembly used in conjunction with a fuel lighter having a fuel reservoir body, the igniter assembly comprising:

a. a strike wheel having an internal axis bore extending therethrough and an external striking surface being in contact with a flint for generating sparks directed toward a nozzle when the striking surface is driven to strike against the flint;

b. an axle positioned within said internal axis bore of said striker wheel and having a diameter which is smaller than the diameter of said bore;

c. a mounting frame attached said fuel reservoir body and having a spring receptacle and a pair of mounting holes for receiving said axle so that said striker wheel can move from a first position to a second position;

d. spring means received within said spring receptacle and positioned below said flint; and e. said spring means exerting a compressive force against said flint and forcing said flint into contact with said striking surface of said striker wheel, the compressive force exerted by said spring means being insufficient to cause said flint to generate sparks when said striker wheel is in said first position and rotated, and the compressive force exerted by said spring being sufficient to cause said flint to generate sparks when said striker wheel is in said second position and rotated.

7. The igniter assembly in accordance with claim 6, wherein said striking surface of said striker wheel is a knurling surface.

8. The igniter assembly in accordance with claim 6, wherein said first position is located on a lower surface of said internal axis bore of said striker wheel.

9. The igniter assembly in accordance with claim 6, wherein said second position is located on an upper surface of said internal axis bore of said striker wheel and remote from said first position.

* * * * *